US010381123B1

(12) United States Patent
Hagelstein

(10) Patent No.: US 10,381,123 B1
(45) Date of Patent: Aug. 13, 2019

(54) NUCLEAR EXCITATION TRANSFER VIA PHONON-NUCLEAR COUPLING

(71) Applicant: Peter L. Hagelstein, Carlisle, MA (US)

(72) Inventor: Peter L. Hagelstein, Carlisle, MA (US)

(73) Assignee: Industrial Heat, LLC, Raleigh, NC (US)

( * ) Notice: Subject to any disclaimer, the term of this patent is extended or adjusted under 35 U.S.C. 154(b) by 0 days.

(21) Appl. No.: 15/723,116

(22) Filed: Oct. 2, 2017

Related U.S. Application Data

(60) Provisional application No. 62/402,460, filed on Sep. 30, 2016.

(51) Int. Cl.
*G21K 5/00* (2006.01)

(52) U.S. Cl.
CPC ..... *G21K 5/00* (2013.01)

(58) Field of Classification Search
CPC .. G21K 5/00; G21K 5/02; G21K 5/08; G21K 1/00; G21K 1/02; G21K 1/10; G21F 3/00
See application file for complete search history.

(56) References Cited

U.S. PATENT DOCUMENTS 4,742,340 A * 5/1988 Nowik ..... B07C 5/346 250/302

FOREIGN PATENT DOCUMENTS

CN 1973919 A * 6/2007

* cited by examiner

*Primary Examiner* — David E Smith
(74) *Attorney, Agent, or Firm* — NK Patent Law

(57) ABSTRACT

An apparatus includes a support and a radioactive source on the support. The radioactive source includes nuclei. An excitation element is coupled to the support. Upon activation of the excitation element, radiation emission from the radioactive source is reduced. The excitation element includes a vibration source. Excitation is transferred from nuclei of the radioactive source to nuclei of the support. The excitation transfer occurs in bulk from multiple nuclei of the radioactive source. The excitation transfer causes emissions from the support.

13 Claims, 10 Drawing Sheets

$$\Delta E = \Delta n \, \hbar \omega_0$$

$$\text{If so then} \quad \Delta n = \frac{\Delta E}{\hbar \omega_0}$$

$$\Delta E = \Delta n \, \hbar \omega_0$$

$$\text{If so then} \quad \Delta n = \frac{\Delta E}{\hbar \omega_0}$$

NUCLEAR EXCITATION TRANSFER VIA PHONON-NUCLEAR COUPLING

CROSS-REFERENCE TO RELATED APPLICATION

This application claims the benefit of priority of U.S. provisional patent application No. 62/402,460, titled "NUCLEAR EXCITATION TRANSFER VIA PHONON-NUCLEAR COUPLING," filed on Sep. 30, 2016, which is incorporated herein in its entirety by this reference.

TECHNICAL FIELD

The present disclosure relates to condensed matter and nuclear sciences. More particularly, the present disclosure relates to excitation transfer.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In at least one embodiment, an apparatus includes: a support; a radioactive source on the support, the radioactive source comprising nuclei; and an excitation element coupled to the support. Upon activation of the excitation element, radiation emission from the radioactive source is reduced.

In at least one example, the excitation element includes a vibration source.

In at least one example, excitation is transferred from nuclei of the radioactive source to nuclei of the support.

In at least one example, the excitation transfer occurs in bulk from multiple nuclei of the radioactive source.

In at least one example, the excitation transfer causes emissions from the support.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
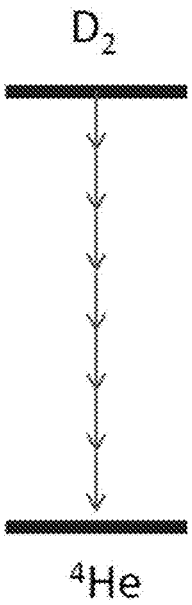
FIG. 1 is a down-conversion diagram according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

These descriptions relate to novel and non-obvious advancements in Condensed Matter Nuclear Science. Experiments have provided evidence of a number of observations:

Heat energy, thought to be a nuclear effect, but without commensurate energetic nuclear radiation;

He-4 commensurate with and correlated with heat energy;

Tritium production;

Collimated x-ray and gamma emission.

An explanatory theory as described herein uses developed models to account for heat energy and other anomalies. The approach is based, according to inventive embodiments, on the notion of massive up-conversion and down-conversion. According to inventive embodiments, conversion occurs between large nuclear quanta and large numbers of low-energy vibrational quanta.

FIG. 1 is a down-conversion diagram according to at least one embodiment. A simplest conceptual approach may be used, but math favors intermediate steps where many metastable nuclei with a lower energy transition are excited.

Figure 2:
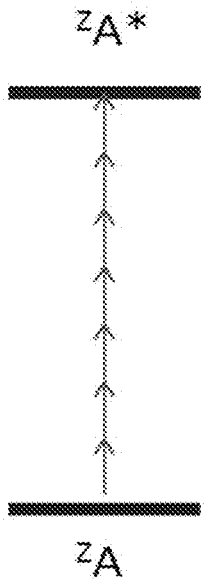
FIG. 2 is an up-conversion diagram according to at least one embodiment.

FIG. 2 is an up-conversion diagram according to at least one embodiment. With respect to the simplest possible up-conversion experiment, this mechanism is proposed as responsible for collimated x-ray emission in the Karabut experiment.

Parts of the model according to at least one embodiment follow. One part of the theoretical approach involves models for two-level systems coupled with a highly-excited oscillator. Prior models that may be known in the literature to up-convert and down-convert do not anticipate this. Prior approaches don't expect (macroscopic) phonon exchange with (subatomic) nuclear transitions. Relativistic interaction for this coupling is proposed. Relativistic coupling are known in the literature, but in other disparate non-analogous applications.

An approach according to embodiments herein: Includes a model that results in and is capable of describing anomalies systematically; Theory is connected with experiment, one piece at a time; Includes focus on collimated x-ray emission as a test problem in recent years; and Includes phonon-nuclear coupling.

Phonon-Nuclear Coupling—Relativistic Problem:

$$\hat{H} = \sum_j \alpha_j \cdot c[p_j - q_j A(r_j)] + \sum_j \beta_j mc^2 + \sum_{j<k} \hat{V}_{jk}(r_k - r_j) + \sum_j q_j \Phi(r_j)$$

$$MR = \sum_j m r_j$$

$$\hat{P} = \sum_j \hat{p}_j$$

$$Q = \sum_j q_j$$

$$\xi_j = r_j - R$$

$$\hat{\pi}_j = \hat{p}_j - \frac{P}{N}$$

$$\hat{H} = \sum_j \alpha_j \cdot c\left[\frac{\hat{P}}{N} + \pi_j - q_j A(R + \xi_j)\right] + \sum_j \beta_j mc^2 + \sum_{j<k} \hat{V}_{jk}(\xi_k - \xi_j) + \sum_j q_j \Phi(R + \xi_j)$$

Foldy-Wouthuysen Type of Rotation:

$$\hat{H}' = e^{i\hat{S}}\left(\hat{H} - i\hbar\frac{\partial}{\partial t}\right)e^{-i\hat{S}}$$

$$= \hat{H} + i[\hat{S}, \hat{H}] - \frac{1}{2}[\hat{S}, [\hat{S}, \hat{H}]] + \ldots - \hbar\frac{\partial \hat{S}}{\partial t} - \frac{i}{2}\left[\hat{S}, \hbar\frac{\partial \hat{S}}{\partial t}\right] + \ldots$$

$$\hat{S} = -i\frac{1}{2Mc}\sum_j \beta_j \alpha_j \cdot \left[\hat{P}_j - QA(R)\right]$$

Rotation works on the center of mass degrees of freedom.

Nucleus as a Particle:

$$\hat{H}' = \frac{|\hat{P} - QA|^2}{2M}\frac{1}{N}\sum_j \beta_j + Q\Phi - \frac{\hbar Q}{2M}\frac{1}{N}\sum_j \beta_j \hat{\sum_j} \cdot B - \frac{\hbar^2 Q}{8M^2c^2}\nabla \cdot E + \frac{\hbar Q}{8M^2c^2}\sum_j \hat{\sum_j} \cdot \left[(\hat{P} - QA) \times E - E \times (\hat{P} - QA)\right]$$

Internal Nuclear Structure:

$$+\sum_j \beta_j mc^2 + \sum_j \alpha_j \cdot c\hat{\pi}_j + \sum_{j<k} \hat{V}_{jk} + \sum_j \left[q_j \Phi(R + \xi_j) - \frac{Q}{N}\Phi(R)\right] - \sum_j \alpha_j \cdot c\left[q_j A(R + \xi_j) - \frac{Q}{N}A(R)\right] + \sum_j \beta_j \frac{(\hat{P} - QA) \cdot \hat{\pi}_j}{M} + \frac{1}{2Mc}\sum_{j<k}\left[(\beta_j \alpha_j + \beta_k \alpha_k) \cdot (\hat{P} - QA), \hat{V}_{jk}\right] + \ldots$$

-continued $$\hat{H}' = \underbrace{\frac{|\hat{P}|^2}{2M}}_{\text{nucleus as a particle}} + \sum_j \beta_j mc^2 + \underbrace{\sum_j \alpha_j \cdot c\hat{\pi}_j + \sum_{j<k} \hat{V}_{jk}}_{\text{internal nuclear structure}} + a \cdot c\hat{P} + \ldots$$

Where $$a \cdot c\hat{P} = \left\{\sum_j \beta_j \frac{\hat{\pi}_j}{M} + \frac{1}{2Mc}\sum_{j<k}\left[(\beta_j \alpha_j + \beta_k \alpha_k), \hat{V}_{jk}\right]\right\} \cdot \hat{P}$$

↑

(↑—accounting for coupling between center of mass motion and internal nuclear degrees of freedom)

Phonon-nuclear coupling is present in relativistic models. Interaction can be rotated out for a composite in free space. For interacting nuclei, for some examples it is inconvenient to rotate it out. Examples where this is true are connected with the anomalies.

Homonuclear Diatomic Molecule:

Motivation for diatomic molecule: Interested in simplest possible version of problem involving phonon-nuclear coupling; Work with nuclear transitions in two nuclei (fewest possible); Work with identical nuclei (energy levels degenerate); Make use of diatomic molecule (simplest system that can vibrate); Would like electric dipole (E1) transition if possible; and would like lowest energy nuclear transition, to maximize effect.

Low Energy Nuclear Transitions:

| Nucleus | Excited state energy (keV) | Half-life | Multipolarity |
|---|---|---|---|
| $^{201}$Hg | 1.5648 | 81 ns | M1 + E2 |
| $^{181}$Ta | 6.24 | 6.05 μs | E − 1 |
| $^{169}$Tm | 8.41017 | 4.09 ns | M1 + E2 |
| $^{83}$KR | 94,051 | 154.4 ns | M1 + E2 |
| $^{187}$Os | 9.75 | 2.38 ns | M1(+E2) |
| $^{73}$Ge | 13.2845 | 2.92 μs | E2 |
| $^{57}$Fe | 14.4129 | 98.3 ns | M1 + E2 |

Low Energy E1 Candidates:

| isotope | T1/2 (ground) | E(keV) | T1/2 (excited) | Multipole |
|---|---|---|---|---|
| Ta-181 | Stable | 6.237 | 6.05 μs | E1 |
| Dy-161 | Stable | 25.651 | 29.1 ns | E1 |
| Pa-229 | 1.5 d | 11.6 | (not known) | E1 |
| Ac-227 | 21.77 y | 27.369 | 38.3 ns | E1 (+M2) |
| Ta-179 | 1.82 y | 30.7 | 1.42 μs | E1 |
| Ra-225 | 14.9 d | 31.56 | 2.1 ns | E1 |
| Ir-190 | 11.78 d | 36.154 | >2 μs | E1 |
| Th-227 | 18.70 d | 37.063 | (not known) | E1 |

Figure 3:
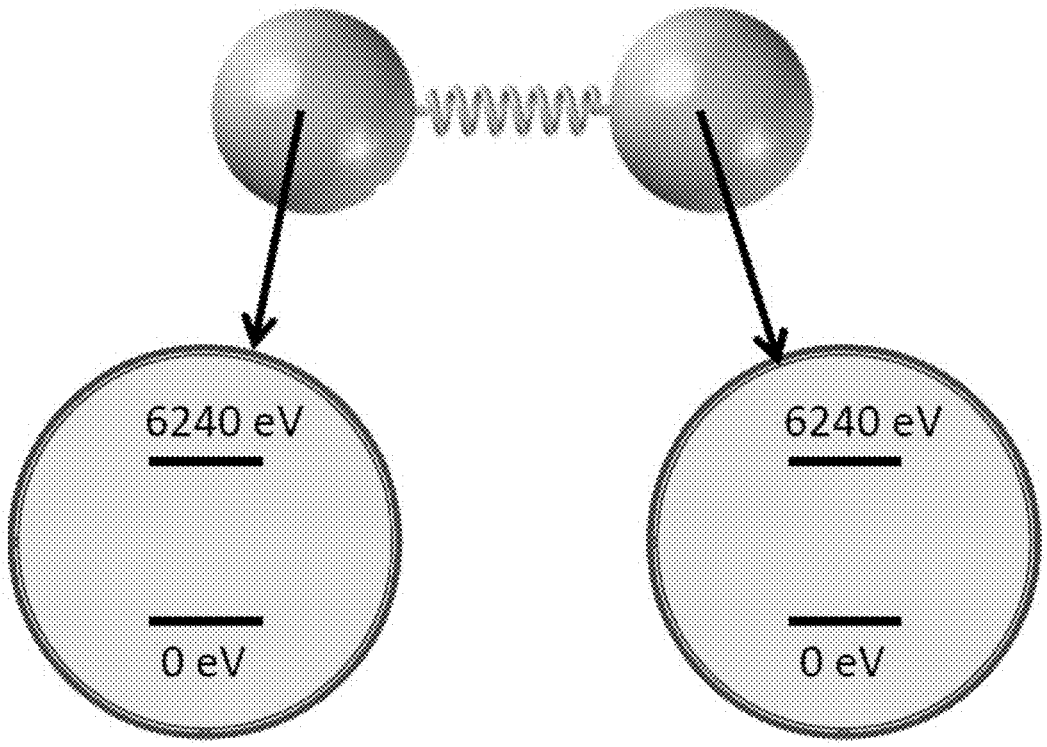
FIG. 3 shows a homonuclear diatomic $Ta_2$ according to at least one embodiment.

FIG. 3 shows a homonuclear diatomic $Ta_2$.

Model for Diatomic Molecule:

$$\hat{H} = \underbrace{M_1c^2 + M_2c^2}_{\text{nuclear states}} + \overbrace{\frac{|P_1|^2}{2M} + \frac{|P_2|^2}{2M}}^{\text{molecule}} + U(R_2 - R_1) + \underbrace{a_1 \cdot c\hat{P} + a_2 \cdot c\hat{P}}_{\text{phonon-nuclear coupling}}$$

Figure 4:
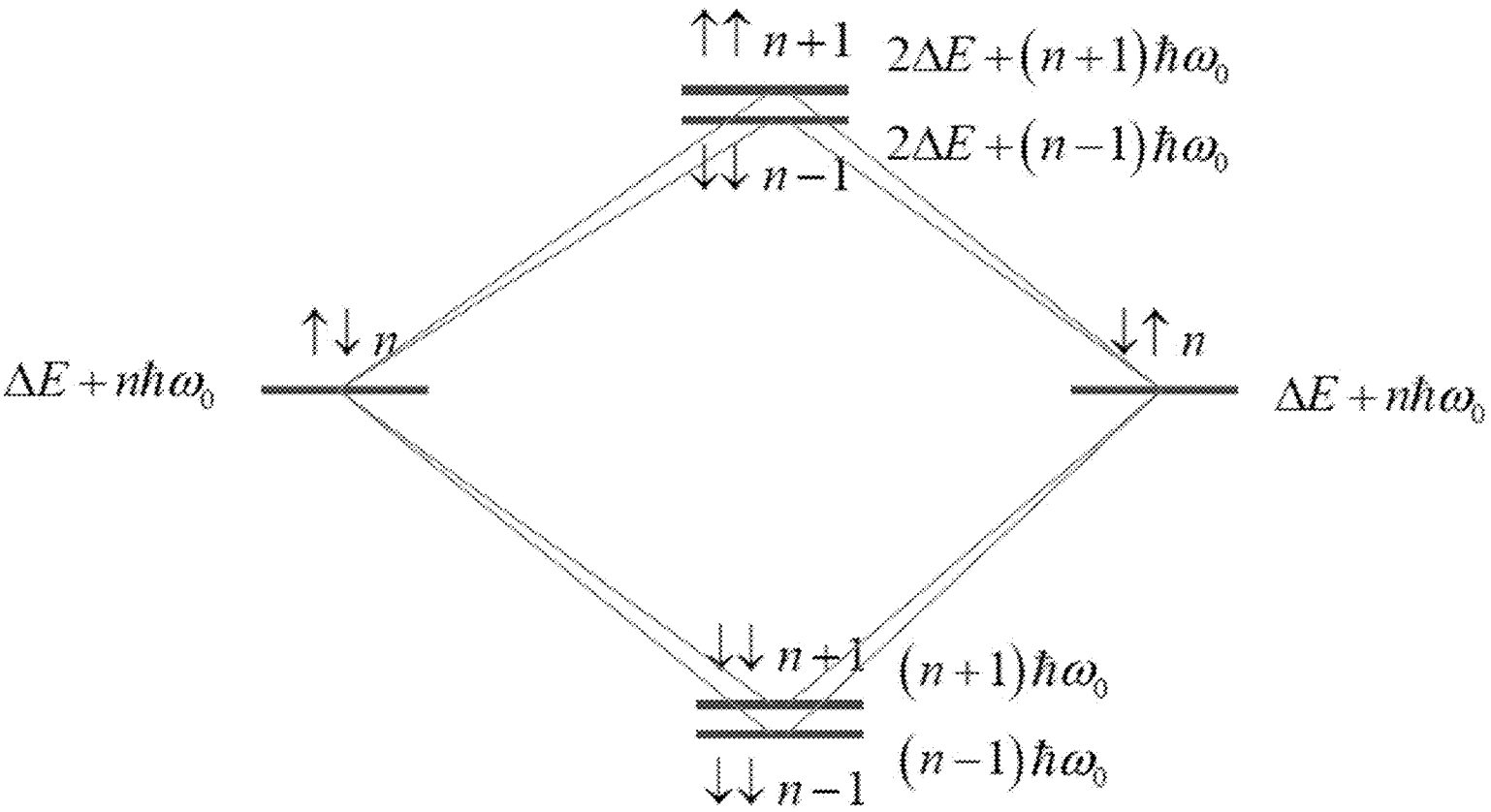
FIG. 4 shows a model for excitation transfer according to at least one embodiment.

A model for excitation transfer according to at least one embodiment is shown in FIG. 4.

Indirect coupling coefficient—Carry out a calculation for the vibrational ground state, and for degenerate nuclear states:

$$\langle I^* M_1, IM_2, n=0|\hat{V}_{12}|IM_1, I^* M_2, n=0\rangle = -\frac{\mu c^2(\hbar\omega_0)^2}{\Delta E^2}\frac{M_1 M_2}{\sqrt{I(I+1)(2I+1)I^*(I^*+1)(2I^*+1)}}|(I^*\|a\|I)|^2$$

Equivalent Hamiltonian:

$$\hat{H}_{12} = -\frac{\mu c^2(\hbar\omega_0)^2}{\Delta E^2}\frac{|(I^*\|a\|I)|^2}{|(I^*\|\hat{I}\|I)|^2}\frac{(I_1\cdot R_{12})(I_2\cdot R_{12})}{|R_{12}|^2}$$

A homonuclear diatomic $Ta_2$ presents a physics problem for phonon-nuclear coupling. Good analysis of indirect coupling for excitation transfer is provided. Excitation transfer leads to a splitting that may be observable. New splitting is different than electric field gradient quadrupole splitting, closer to, but different than, nuclear spin-spin splitting.

Diatomic $^{57}Fe$ in an Argon Matrix—Analog in Diatomic $^{57}Fe$:

Mossbauer experiments have been done in diatomic Fe-57. Molecules formed in argon matrix near liquid helium temperature. Mossbauer spectra observed for diatomic $Fe_2$. Large quadrupole splitting due to electric field gradient may be observed. Phonon-nuclear coupling may be observed in diatomic Ta2 Mossbauer process.

Figure 5:
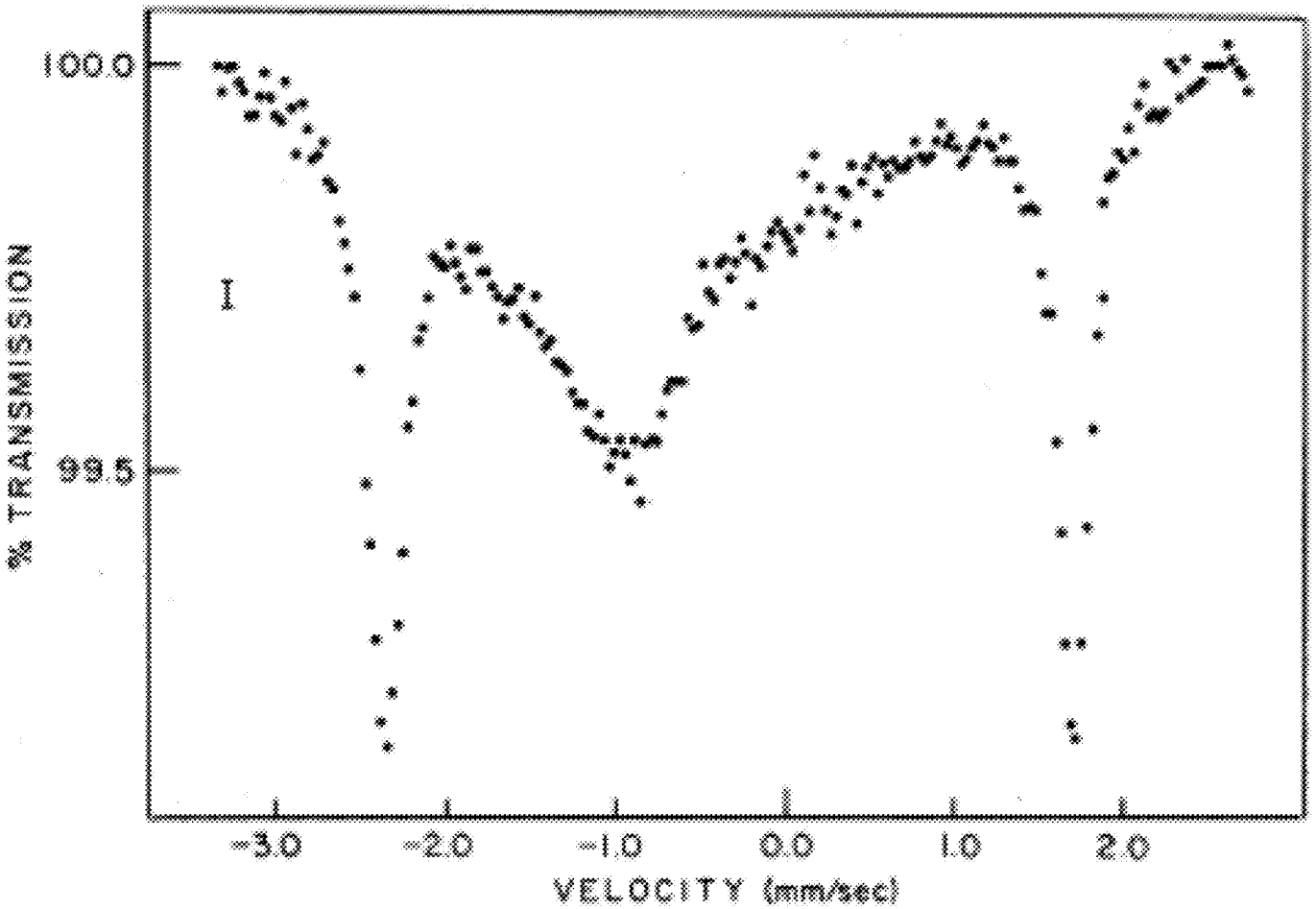
FIG. 5 is a Mossbauer spectra of the prior art.

FIG. 5 is a Mossbauer spectra of the prior art (P H Barrett and T K McNab, Phys Rev Lett 25 (1970) 1601)).

Regarding diatomic $Ta_2$: Mossbauer effect has been studied for Ta-181 transition at 6240 eV; Diatomic $Ta_2$ molecule has been observed; Optical measurements have been done on $Ta_2$ in an argon matrix; analogous Mossbauer experiments have not been done for $Ta_2$ in an argon matrix; the ground state of diatomic $Fe_2$ is an electronic spin singlet, but ground state of $Ta_2$ may not be, presenting a challenge.

Excitation transfer with $^{181}Ta$—Possibility of observing excitation transfer: Elegant observation of phonon-nuclear coupling in $^{181}Ta_2$, Issues with $^{201}Hg_2$ at 1565 eV, since not an E1 transition, are considered; and various ways to verify phonon-nuclear coupling are considered.

Figure 6:
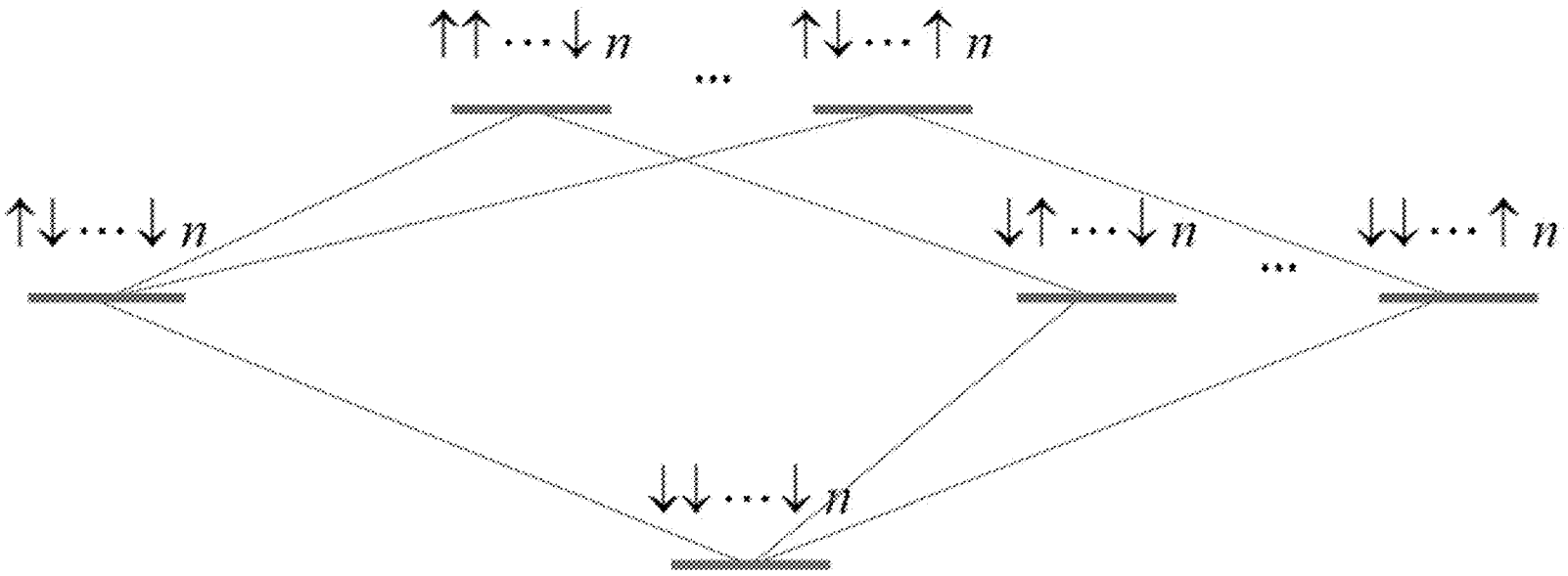
FIG. 6 is an excitation transfer scheme according to at least one embodiment.

FIG. 6 is an excitation transfer scheme according to at least one embodiment, by which to transfer excitation from one nucleus to another, where there are many others to go to.

Excitation transfer with more nuclei gives a more complicated mathematical problem, but includes similar physics as for up-conversion and down-conversion models. If off-resonant loss is different than on-resonant loss, then one would expect an acceleration of excitation transfer effect. This could be observed by looking at different positions in space.

Figure 7:
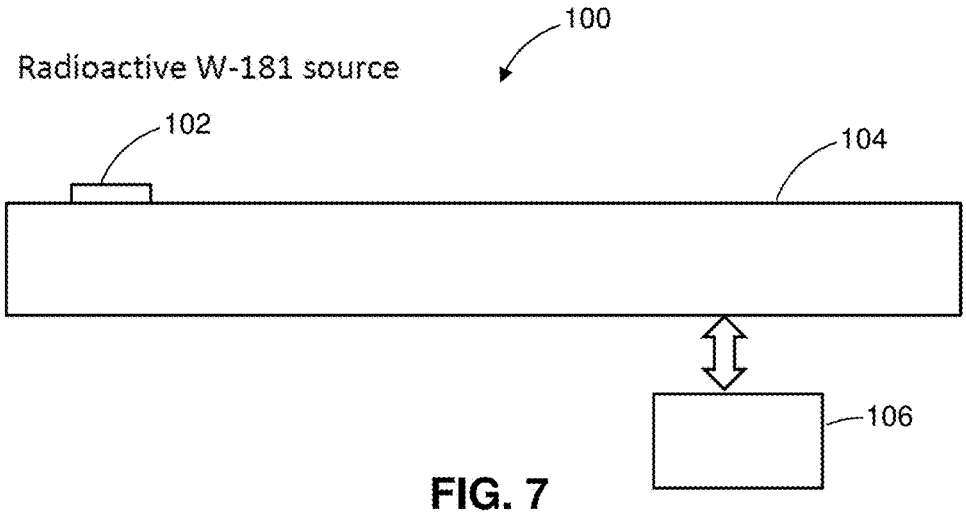
FIG. 7 is a schematic of a process apparatus according to at least one embodiment.

FIG. 7 is a schematic of a process apparatus 100, according to at least one embodiment, that includes a radioactive W-181 source 102.

Figure 8:
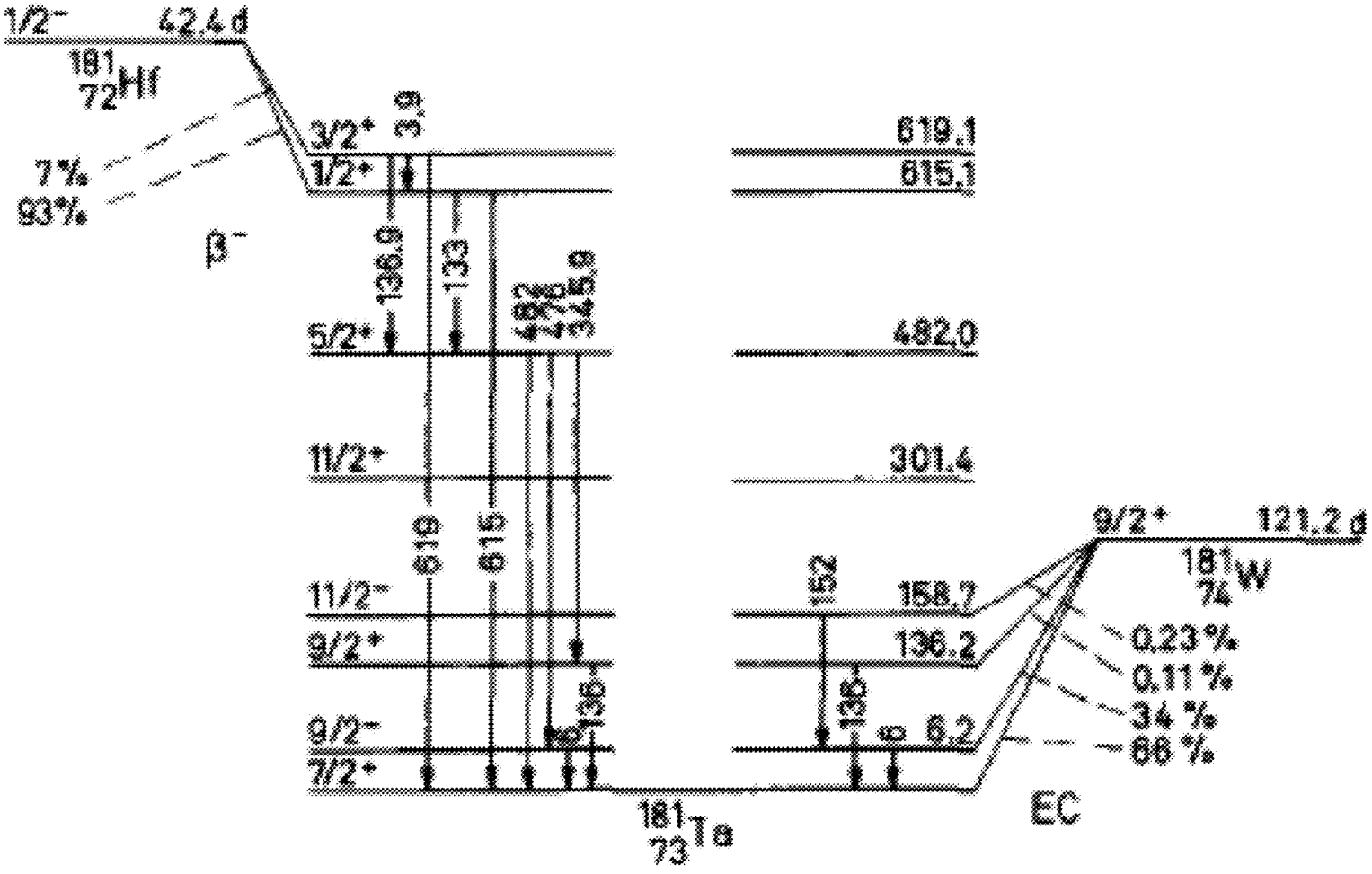
FIG. 8 is a decay scheme of the prior art, in which W-181 decays to Ta-181.

FIG. 8 is a decay scheme of the prior art, in which W-181 decays to Ta-181.

Figure 9:
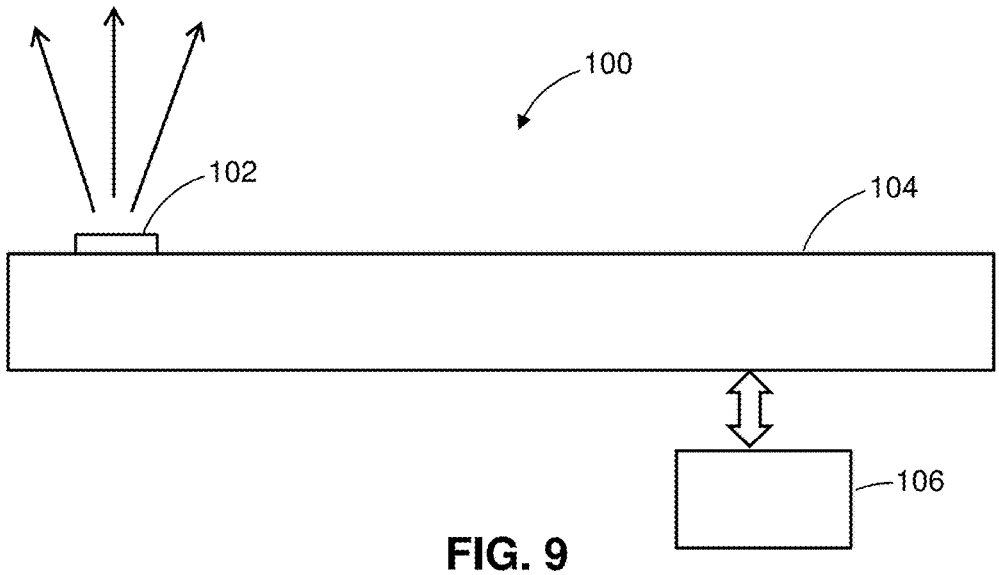
FIG. 9 is a schematic of the process apparatus of FIG. 7, in which gamma emission emanates from the location of the radioactive W-181 source.

FIG. 9 is a schematic of the process apparatus 100 of FIG. 7, in which gamma emission emanates from the location of the radioactive W-181 source 102.

Excitation transfer—stimulation by vibrations has the potential to cause excitation transfer effect. As excitation transfer occurs, less emission from the location of radioactive source 102 occurs as excitation is transferred to other nuclei which see common excited vibrational modes. Thus emissions are seen from other parts of a support plate 104.

Figure 10:
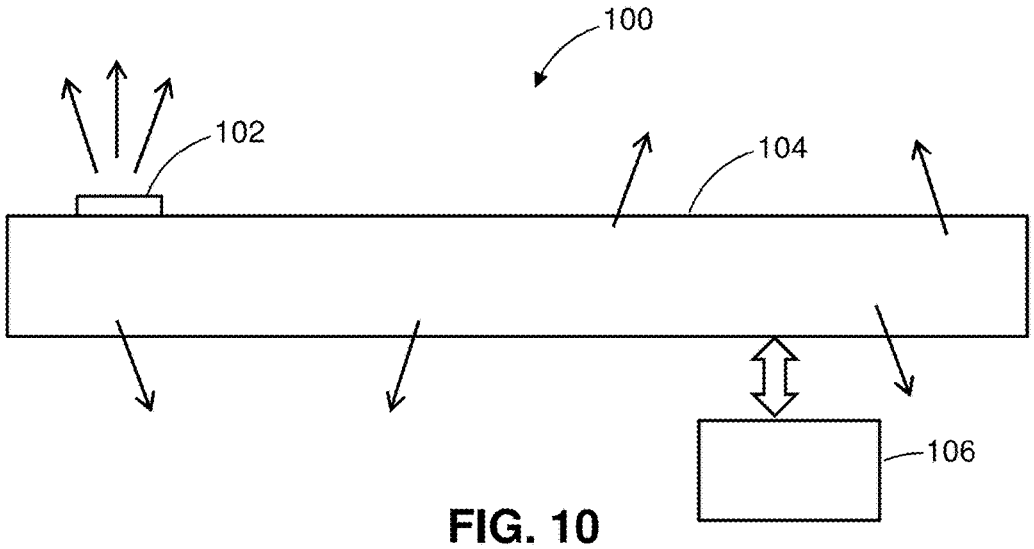
FIG. 10 is a schematic diagram of the process apparatus of FIG. 7 in which excitation transfer occurs.

FIG. 10 is a schematic diagram of the process apparatus of FIG. 7 in which excitation transfer occurs. If the plate is thick, then most of the radiation would be absorbed internally.

Embodiments for excitation transfer include: Putting the W-181 source 102 on surface of Ta-181 support plate 104; Check that 6240 eV emission occurs from location of source; Then vibrate using a vibration source 106 coupled to the support plate 104 to cause excitation transfer; Measure reduction of emission from location of source; Measure emission from locations where no source is present; Effect suggests that loss be different in off-resonant states in order to be a big effect.

A candidate for observed anomalies is provided. A potential is to account systematically for all anomalies. A model for massive up-conversion and down-conversion effects is provided. A model for phonon-nuclear coupling is provided. Level shift due to phonon-nuclear coupling in a diatomic molecule may occur. $Ta_2$ is promising. Challenges are present due to the electronic ground state not being a singlet.

In an at least one embodiment, excitation transfer occurs in a W-181 source device to produce excited state Ta-181. Excitation transfer is used to move the excitation from the source location to other nuclei. Vibrations are to stimulate excitation transfer effect to reduce emission at source location. Emission is seen from other parts of the plate.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. An apparatus comprising:

a support;

a radioactive source on the support, the radioactive source comprising nuclei; and an excitation element coupled to the support, wherein upon activation of the excitation element, radiation emission from the radioactive source is reduced wherein excitation is transferred from at least one decay product nucleus of the radioactive source to one or more nuclei of the support; wherein the one or more nuclei of the support to which the excitation is transferred are of the same isotope as the decay product nucleus.

2. The apparatus of claim 1, wherein the excitation element comprises a vibration source.

3. The apparatus of claim 1, wherein excitation is transferred from nuclei of the radioactive source to nuclei of the support.

4. The apparatus of claim 3, wherein the excitation transfer occurs in bulk from multiple nuclei of the radioactive source.

5. The apparatus of claim 3, the excitation transfer causes emissions from the support.

6. The apparatus of claim 1, wherein the excitation is transferred by a process in which excitation is transferred from the decay product nucleus in an excited state to the one or more nuclei of the support.

7. The apparatus of claim 6, wherein the process by which the excitation is transferred comprises energy being transferred from the decay product nucleus in the excited state to the one or more nuclei of the support.

8. The apparatus of claim 7, wherein the one or more nuclei of the support to which the energy is transferred are each in a ground state of the isotope before the energy is transferred.

9. The apparatus of claim 8, wherein each of the one or more nuclei of the support to which the energy is transferred are temporarily in at least one excited state of the isotope after the energy is transferred.

10. The apparatus of claim 7, wherein the decay product nucleus is in the excited state before the excitation is transferred due to radioactive decay of the radioactive source.

11. The apparatus of claim 6, wherein the process by which the excitation is transferred comprises the energy being transferred from the decay product nucleus in the excited state to the one or more nuclei of the support without being transferred through gamma ray emission and subsequent absorption.

12. The apparatus of claim 11, wherein the process by which the excitation is transferred comprises the energy being transferred from the decay product nucleus in the excited state to the one or more nuclei of the support without any intermediate particle or nucleus carrying the transferred energy.

13. The apparatus of claim 12, wherein the process by which the excitation is transferred comprises the energy being transferred via coupling to off-resonant states where energy is not conserved.

* * * * *